US007954338B2

(12) United States Patent
Lien

(10) Patent No.: US 7,954,338 B2
(45) Date of Patent: Jun. 7, 2011

(54) WATER STORAGE UNIT WITH DUAL BLADDERS

(76) Inventor: Chien Ping Lien, Taipei Hsien (TW)

( * ) Notice: Subject to any disclaimer, the term of this patent is extended or adjusted under 35 U.S.C. 154(b) by 476 days.

(21) Appl. No.: 12/285,392

(22) Filed: Oct. 3, 2008

(65) Prior Publication Data

US 2010/0084411 A1 Apr. 8, 2010

(51) Int. Cl.

| | |
|---|---|
| ***F25D 3/08*** | (2006.01) |
| ***A41F 1/00*** | (2006.01) |
| ***B65D 33/16*** | (2006.01) |
| ***B65D 33/25*** | (2006.01) |
| ***B65D 77/18*** | (2006.01) |
| ***B65D 33/06*** | (2006.01) |

(52) U.S. Cl. ..... 62/530; 24/461; 24/462; 24/30.5 R; 383/13; 383/30; 383/69; 383/901

(58) Field of Classification Search ..... 62/530, 62/457.1, 457.3, 457.4, 457.2; 220/62.21, 220/592.16, 592.17, 592.01; 383/13, 38, 383/30, 68, 69, 3, 66, 906, 901; 53/127; 215/396; 224/148.2; 222/130, 146.6; 294/137, 294/170; 24/460, 461, 462, 30.5 R
See application file for complete search history.

(56) References Cited

U.S. PATENT DOCUMENTS

| | | | | |
|---|---|---|---|---|
| 3,523,607 | A * | 8/1970 | Thompson et al. | 206/221 |
| 5,840,080 | A * | 11/1998 | Der Ovanesian | 607/114 |
| 6,571,954 | B2 * | 6/2003 | Nadler | 206/522 |
| 7,780,713 | B2 * | 8/2010 | Roberts | 607/108 |
| 2002/0094140 | A1 * | 7/2002 | Gill | 383/68 |
| 2008/0173670 | A1 * | 7/2008 | Macler | 222/81 |
| 2008/0226207 | A1 * | 9/2008 | Frayne | 383/109 |
| 2010/0044396 | A1 * | 2/2010 | Skillern | 222/209 |

* cited by examiner

*Primary Examiner* — Judy J Swann
*Assistant Examiner* — Devon Russell
(74) *Attorney, Agent, or Firm* — Bacon & Thomas, PLLC

(57) ABSTRACT

A water storage unit includes an outer bag with an inlet defined in a top end thereof and an inner bag is received in the outer bag. A coolant bag is received in the inner bag and has coolant received therein. An outlet part is connected to the lower end of the outer bag and connected with a hose so that the user can suck the water in the outer bag. The water is cooled by the coolant in the coolant bag which is located at the lower end of the outer bag. A handle has a clamp slot with which a sealing rod is securely engaged. The inlet of the outer bag can be sealed by the cooperation of the clamp slot of the handle and the sealing rod.

6 Claims, 8 Drawing Sheets

WATER STORAGE UNIT WITH DUAL BLADDERS

FIELD OF THE INVENTION

The present invention relates to a water storage unit for outdoor use and includes an inner bag with coolant received therein and an outer bag in which the inner bag is received.

BACKGROUND OF THE INVENTION

A conventional water storage unit includes a plate attached to a side of the water bag and the plate includes multiple chambers along a periphery thereof, the chambers are filled with coolants which are gel-type material with high heat transferring factor. The water bag and the plate are frozen before use and the gel-type coolants are solidified with low temperature. Water is then filled into the water bag and heat is absorbed by the coolants such that the user sucks the water of lower temperature. The water bag is received in a backpack and is connected with a hose so that the user can suck the cool water without dismounting the backpack. However, the water bag and the plate occupy a certain space in the freezer and the solidified coolants take the space that water can be filled in the water bag. The coolants are located on one side of the water bag so that the water close to the other side of the water bag cannot be cooled as the water adjacent the coolants. Furthermore, the chambers are located from the top edge to the lower edge of the water bag so that when part of the water is used, the coolants on the higher position of the water bag do not have any function.

FIG. 9 shows a handle 9 which is cooperated with a sealing rod 83 to seal the opening 81 of the water bag 8, the opening 81 goes around the sealing rod 83 and clamped between the sealing rod 83 and the clamping slot (not shown) of the handle 9. The handle 9 includes a carry hole 91 for convenient carry and two engaging holes 93 with which the hose (not shown) connected to the outlet (not shown) of the water bag 8 is engaged to organize the hose. Three hanging holes 92 are defined through the handle 9 such that the use can hang the handle 9 on a wall (not shown). Although the water bag 8 is equipped with sealing snapping members 82 to seal the opening 81, the sealing snapping members 82 cannot bear pressure and are easily opened.

The present invention intends to provide a water storage unit which includes an outer bag and an inner bag in which a coolant bag is received. The coolant bag is located at the bottom of the water storage unit and the outlet part for the water storage unit is located at the bottom thereof so that the water can be cooled by the coolant in the coolant bag efficiently.

SUMMARY OF THE INVENTION

The present invention relates to a water storage unit which comprises an outer bag and an inlet defined in a top end of the outer bag. An inner bag is received in the outer bag and has an opening defined in a top end thereof. Two communication holes are defined in two sides of the inner bag and independent from an interior of the inner bag. A coolant bag is received in the inner bag and coolant is received in the coolant bag. A handle is connected to the inlet of the outer bag and a sealing rod is engaged with a clamp slot defined in an underside of the handle to seal the inlet of the outer bag. The clamp slot includes a guide opening in one end and a closed end on the other end. A through hole is defined through the closed end. An elongate slit is defined between two parts of the clamp slot. The sealing rod is clamped in the clamp slot and has two connection parts on a first end thereof. The connection parts are engaged with the through hole. The sealing rod has multiple axial ridges extending radially therefrom so as to be engaged with insides of the clamp slot. The top end of the outer bag is inserted into the elongate slit of the handle and goes around the sealing rod so that inlet can be sealed.

The primary object of the present invention is to provide a water storage unit wherein the inlet of the outer bag can be well sealed by the cooperation of the handle and the sealing rod.

Another object of the present invention is to provide a water storage unit which includes a coolant bag received in the inner bag and the coolant bag can be individually frozen so as to save the space required in the freezer.

Yet another object of the present invention is to provide a water storage unit wherein the coolant bag is located at the lower end of the outer bag so that the water that the user sucks is ensured to be cooled by the coolant.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
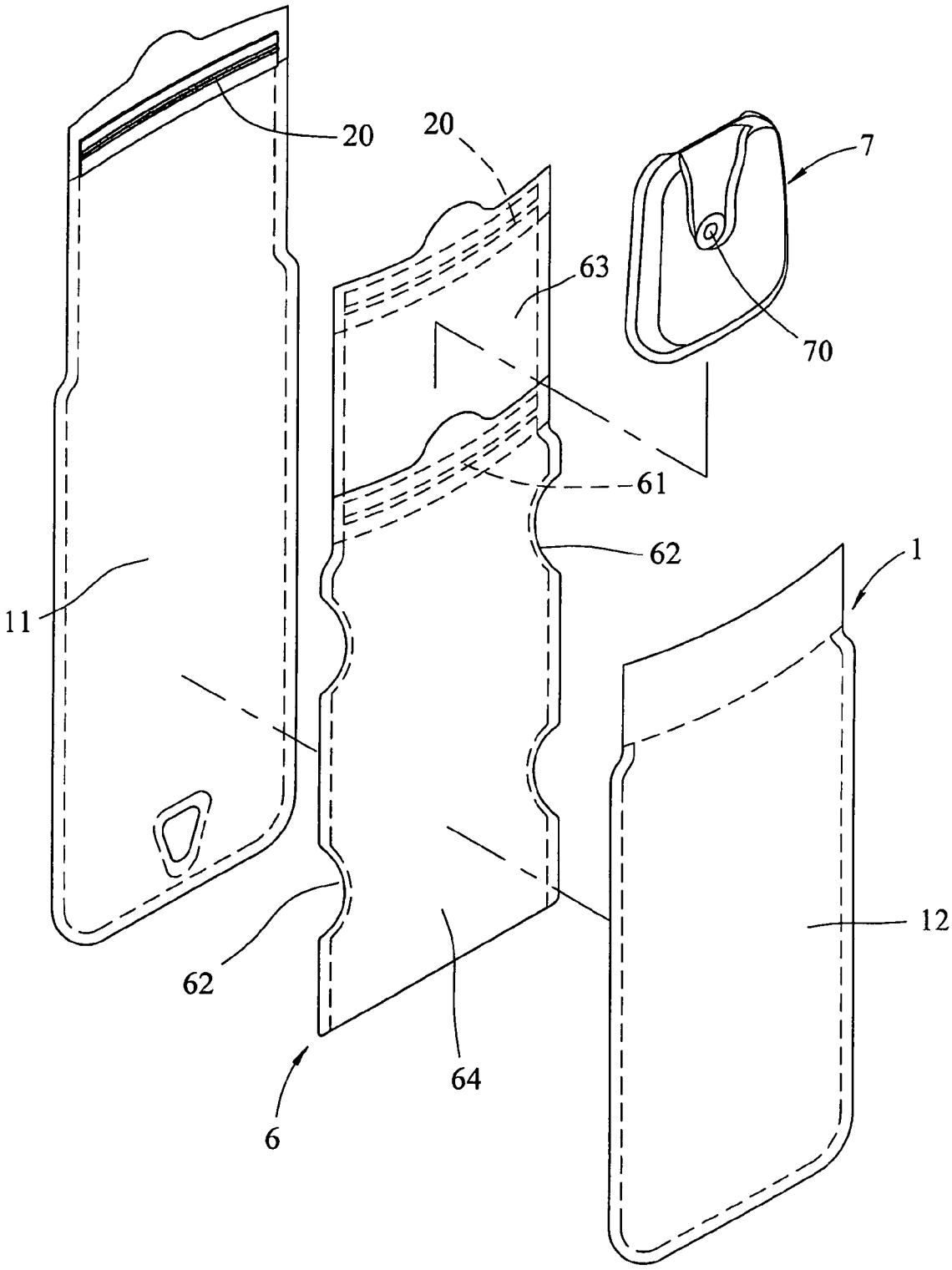
FIG. 1 is an exploded view to show the water storage unit of the present invention.
Figure 2:
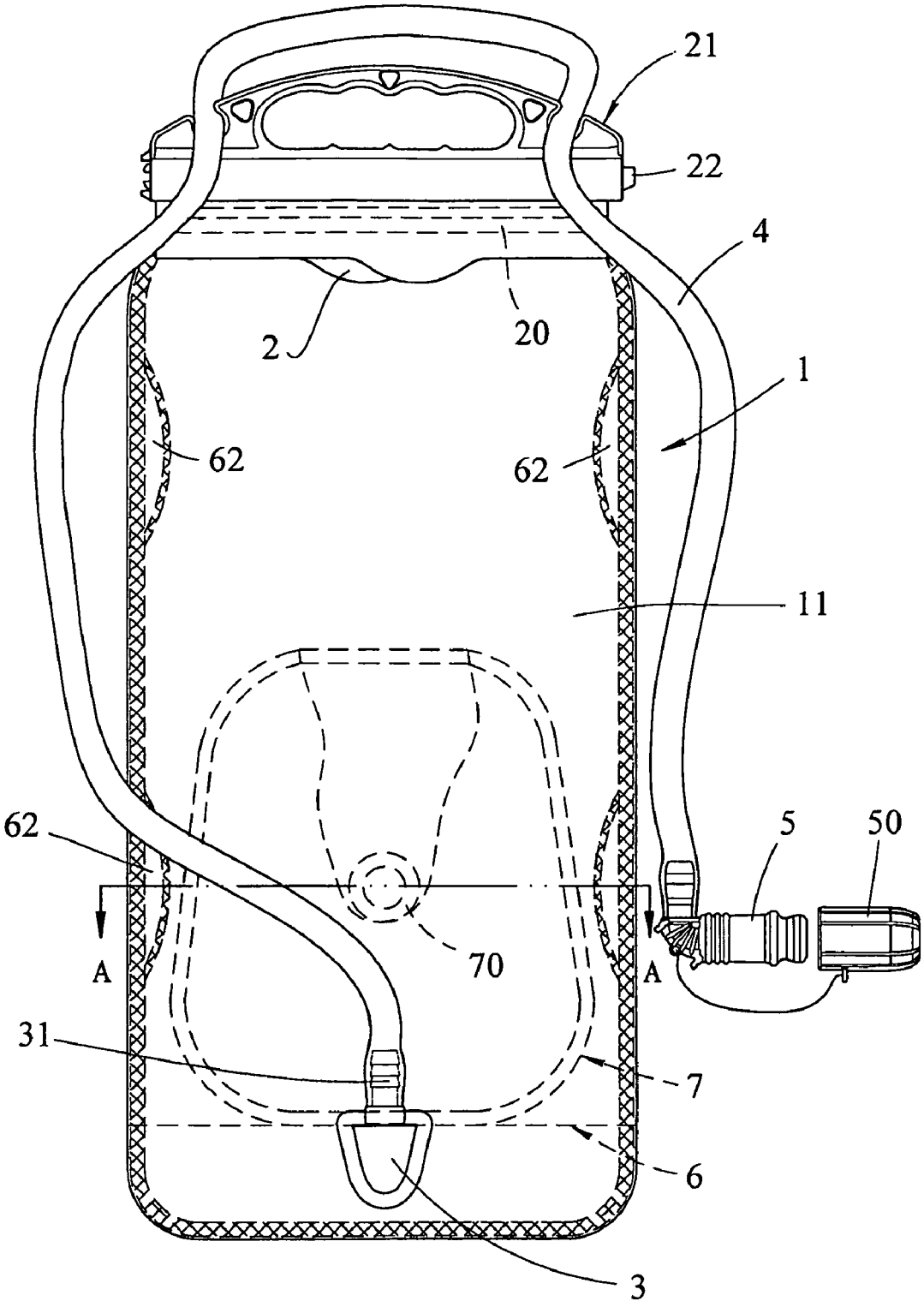
FIG. 2 is a front side view to show the water storage unit cooperated with a handle and a suction unit of the present invention.
Figure 3:
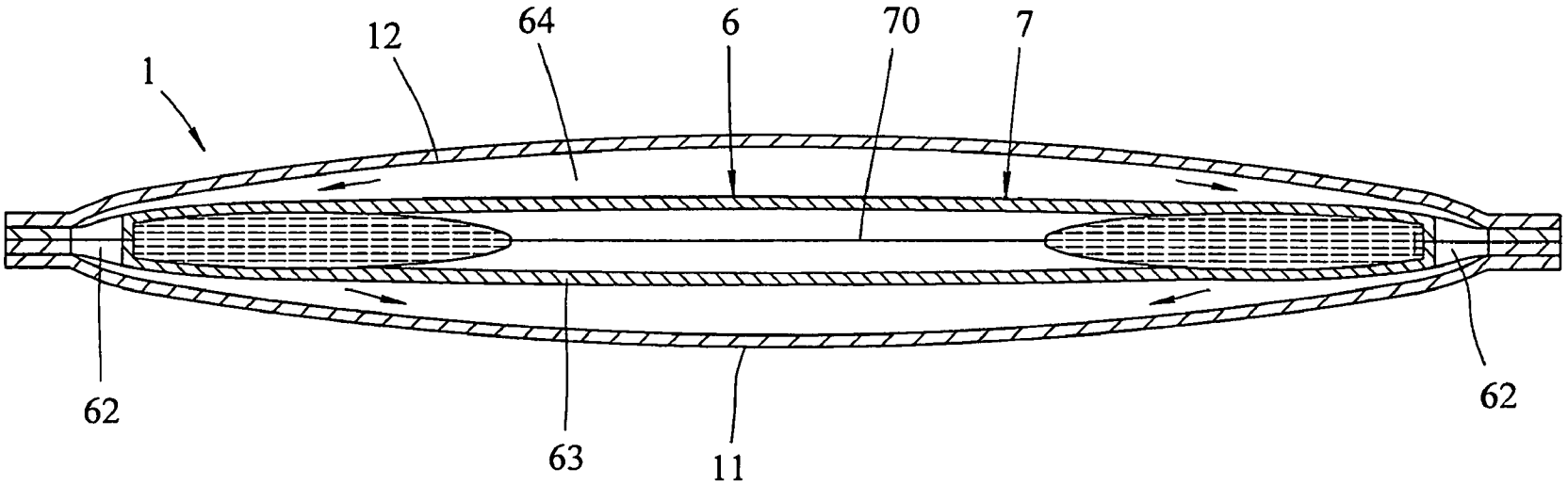
FIG. 3 is a cross sectional view taken along line A-A in FIG. 2.

Referring to FIGS. 1 to 3, the water storage unit of the present invention comprises an outer bag 1 including a first plate 11 and a second plate 12 which is fixed to the first plate 11, an inlet 2 is defined in a top end of the outer bag 1. A first sealing unit 20 is located between the first and second plates 11, 12 and connects the first and second plates 11, 12 to seal the inlet 2. An inner bag 6 includes a third plate 63 and a fourth plate 64 which is fixed to the third plate 63. The inner bag 6 is received in the outer bag 1 and has an opening defined in a top end thereof. Two communication holes 62 are defined in two sides of the inner bag 6 and independent from an interior of the inner bag 6. A second sealing unit 61 is located between the third and fourth plates 63, 64 and connects the third and fourth plates 63, 64 to seal the opening of the inner bag 6.

A coolant bag 7 is received in the inner bag 6 via the opening of the inner bag 6 and coolant 71 is received in the coolant bag 7. The coolant bag 7 has a circular seam 70 on a center thereof so that the coolant 71 is filled around the circular seam 70. The coolant bag 7 can be taken out from the inner bag 6 and put into a freezer to solidify the coolant 71.

Figure 6:
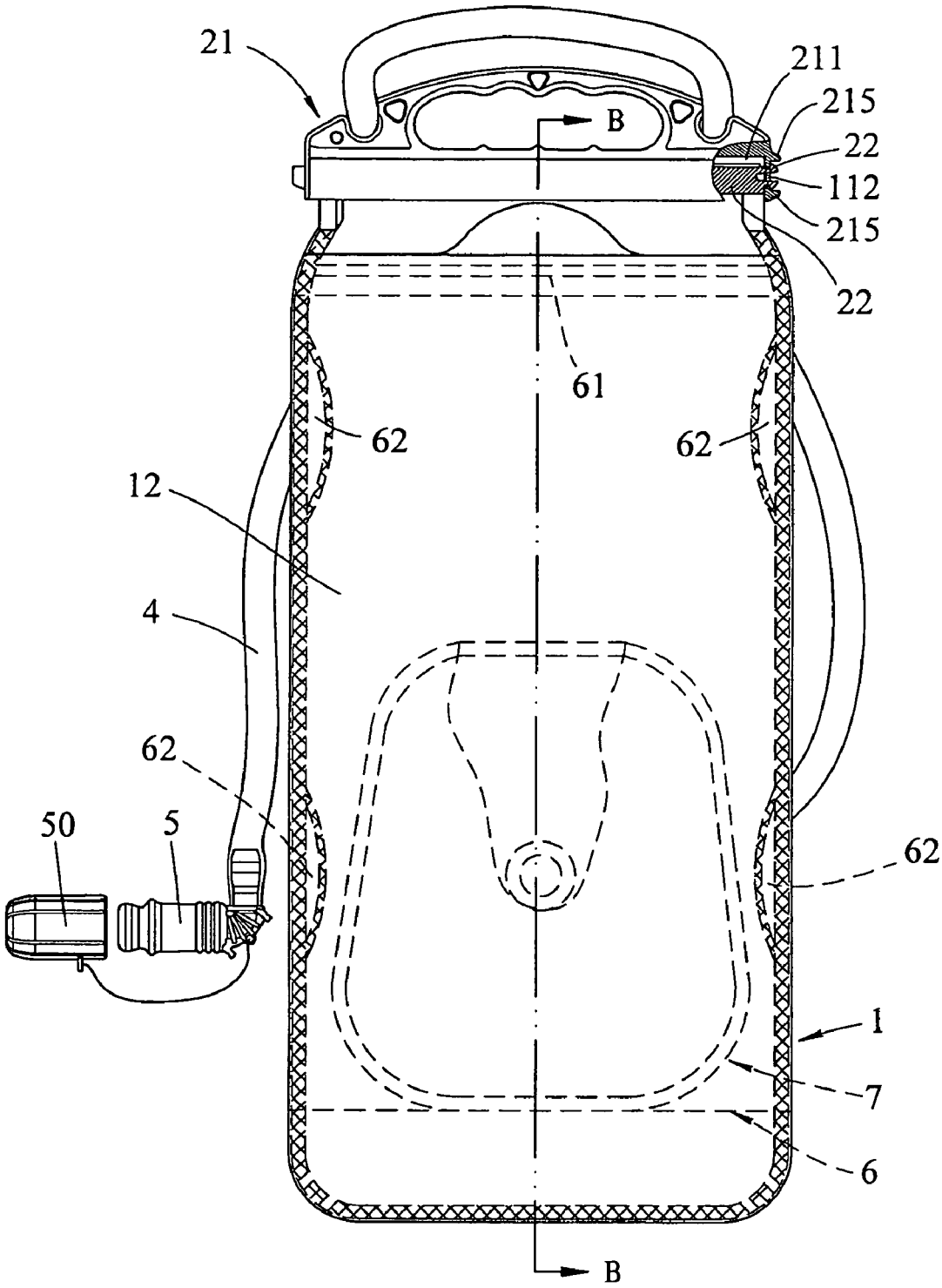
FIG. 6 is a rear side view to show the water storage unit cooperated with the handle and the suction unit of the present invention.
Figure 7:
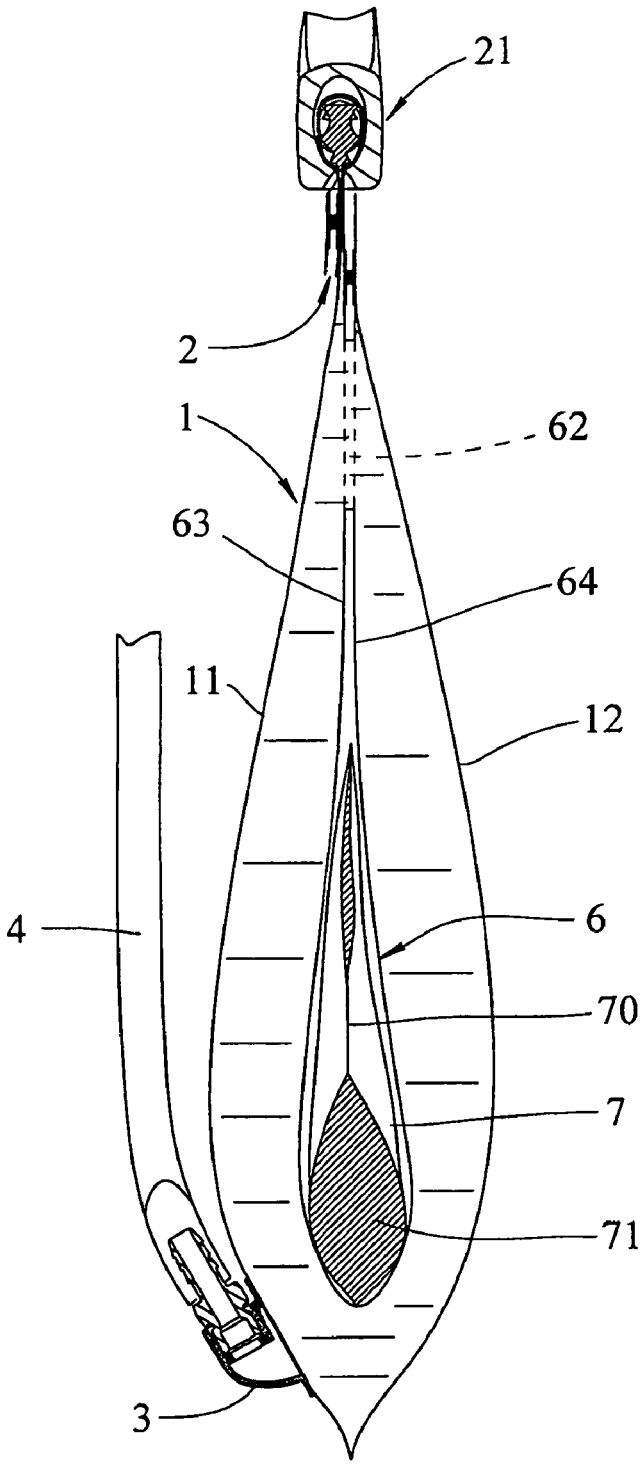
FIG. 7 is a cross sectional view taken along line B-B in FIG. 6.
Figure 8:
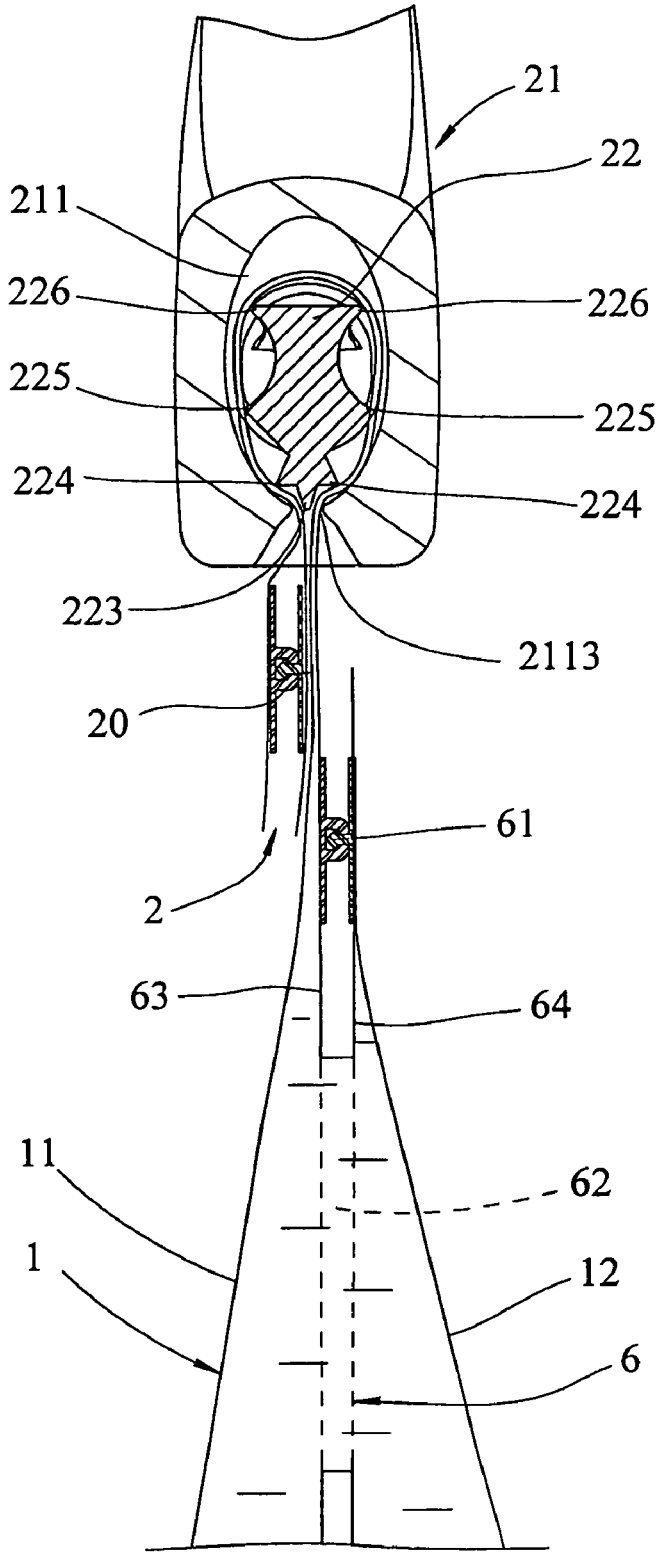
FIG. 8 is an enlarged view to show a part of the cross sectional view in FIG. 7.
Figure 9:
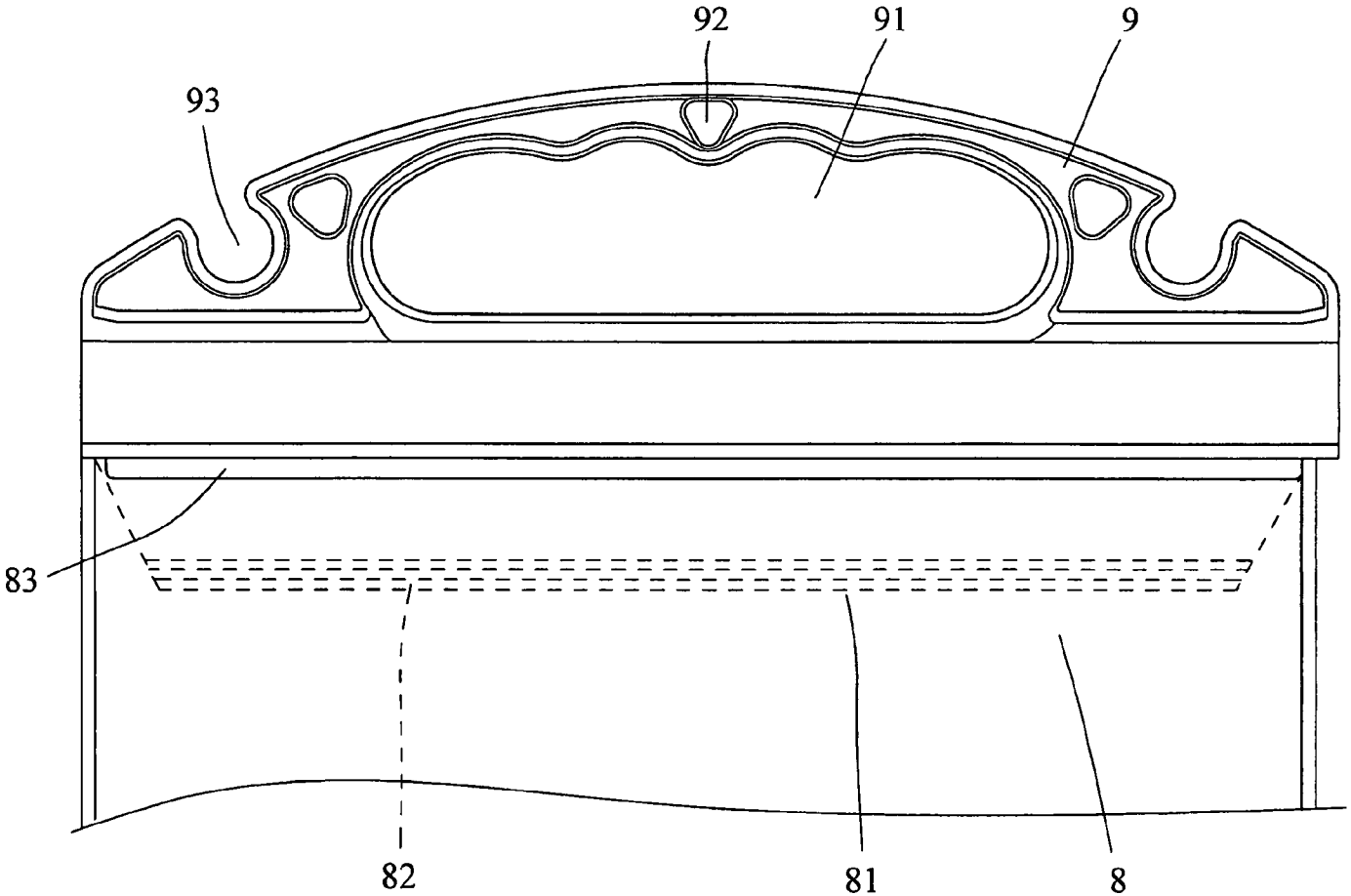
FIG. 9 PRIOR ART
FIG. 9 shows a conventional handle and a conventional water bag.

Further referring to FIG. 6, an outlet part 3 is connected to a lower end of the outer bag 1 and an outlet tube 31 is connected to the outlet part 3. The outlet tube 31 communicates with an interior of the outer bag 1 and is connected with a hose 4 which has a suction piece 5 connected to a distal end thereof. A cap 50 is removably mounted to the suction piece 5 and tied to the suction piece 5 by a rope. The hose 4 can be engaged with the engaging holes 213 in the handle 21 which will be described hereafter.

Figure 4:
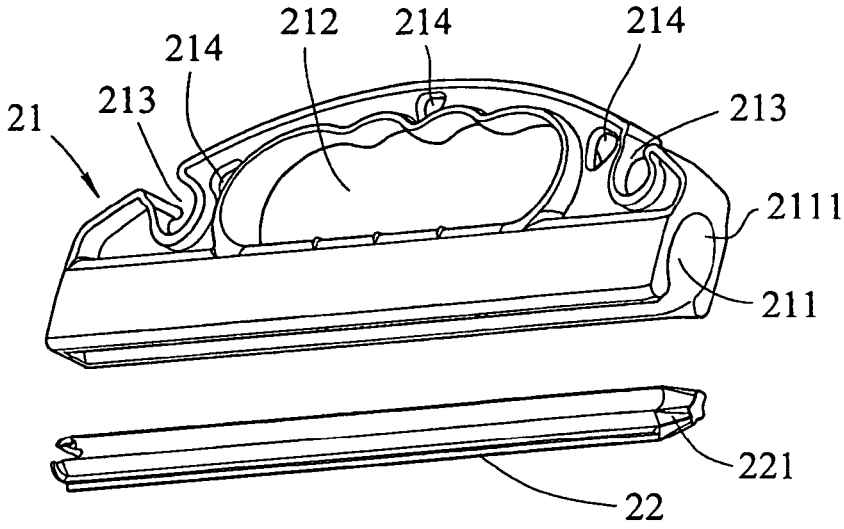
FIG. 4 shows the handle and the sealing rod cooperated with the water storage unit of the present invention.
Figure 5:
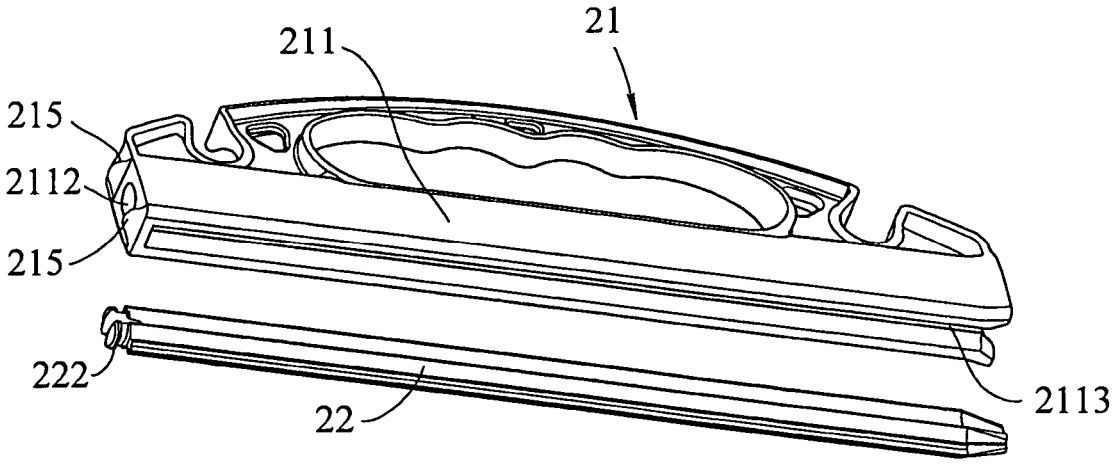
FIG. 5 shows the handle and the sealing rod from another angle of view.

Referring to FIGS. 4 and 5, the handle 21 is connected to the inlet 2 of the outer bag 1 and a sealing rod 22 is engaged with a clamp slot 211 defined in an underside of the handle 21 to seal the inlet 2 of the outer bag 1. The clamp slot 211 includes a guide opening 2111 in one end and a closed end on the other end. A through hole 2112 is defined through the closed end and two protrusions 215 extend from an outside of the close end of the clamp slot 211, the through hole 2112 is located between the two protrusions 215. An elongate slit 2113 is defined between two parts of the clamp slot 211. The sealing rod 22 is clamped in the clamp slot 211 and has two connection parts 222 on a first end thereof. The connection parts 222 are engaged with the through hole 2112 and movable in radial direction of the sealing rod 22 so that the first end of the sealing rod 22 can be extended through the through hole 2112 by squeezing the two connection parts 222 inward. The protrusions 215 protect the two connection parts 222 from being broken during use the handle 21. A guide tapered end 221 is formed on a second end of the sealing rod 22 and located corresponding to the guide opening 2111 in the handle 21. The sealing rod 22 has multiple axial ridges extending radially therefrom so as to be engaged with insides of the clamp slot 211.

The handle 21 includes a carry hole 212 at a center thereof and the two engaging holes 213 are located on two sides of the handle 21. A plurality of hanging holes 214 are defined through the handle 21 and allow the user to hang the handle 21 with the outer bag 1 on a wall or the like.

The top end of the outer bag 1 is inserted into the elongate slit 2113 of the handle 21 and goes around the sealing rod 22 and then extends out from the elongate slit 2113. The first axial ridge 223 is located between the second, third and fourth ridges 224, 225, 226, and the first axial ridge 223 is always located corresponding to the elongate slit 2113. When the axial ridges 223 to 226 on the sealing rod 22 is securely engaged with the inside of the clamp slot 211, the inlet 2 of the outer bag 1 is well sealed.

When the outer bag 1 has a thin wall, the second axial ridges 224 contact two respective lower insides of the two parts of the clamp slot 211 so as to seal the inlet 2. If the outer bag 1 has a wall of mediate thickness, the two third axial ridges 225 contact two respective mediate insides of the two parts of the clamp slot 211 to seal the inlet 2. If the outer bag 1 has a wall of thick thickness, the two fourth axial ridges 226 contact two respective upper insides of the two parts of the clamp slot 211 to seal the inlet 2. In other words, the sealing rod 22 can seal the inlet 2 regardless the thickness of the outer bag 1. The functions of the first to fourth axial ridges 223, 224, 225, 226 also perform an important to seal the inlet 2 when the outer bag 1 is pulled or squeezed and ensure that one of the first, second, third and fourth axial flanges 223 to 226 works to seal the inlet 2.

When adding water into the outer bag 1 which is defined into two sub-spaces by the inner bag 6, the air in the two sub-spaces communicate to each other via the communication holes 62 so as to escape from the inlet 2 of the outer bag 1, such that the water can be filled in the outer bag 1 easily. The inlet 2 is sealed after the water is filled and the water is cooled by the coolant 71 of the coolant bag 7 in the inner bag 6. It is noted that the coolant 71 is always located at the lower end of the outer bag 1 and close to the outlet part 3 so that the water that the user sucks is always cooled.

While we have shown and described the embodiment in accordance with the present invention, it should be clear to those skilled in the art that further embodiments may be made without departing from the scope of the present invention.

What is claimed is:

1. A water storage unit comprising:

an outer bag including a first plate, a second plate which is fixed to the first plate, and an inlet defined in a top end of the outer bag;

an inner bag including a third plate and a fourth plate which is fixed to the third plate, the inner bag received in the outer bag, the inner bag having an opening defined in a top end thereof, two cutouts defined in two sides of the inner bag, said cutouts not in communication with an interior of the inner bag;

a coolant bag received in the inner bag and coolant received in the coolant bag, the coolant bag having a circular seam on a center thereof, and a handle connected to the inlet of the outer bag by wrapping the inlet around a sealing rod, said sealing rod engaged with a clamp slot defined in an underside of the handle to seal the inlet of the outer bag, the clamp slot including a guide opening in one end and a closed end on the other end, a through hole defined through the closed end, an elongate slit defined between two parts of the clamp slot wherein the inlet of the outer bag passes through the slit, said sealing rod having two connection parts on a first end thereof, the connection parts engaged with the through hole in a snap fit, the sealing rod having multiple axial ridges extending radially therefrom so as to be engaged with the inlet of the outer bag and the insides of the clamp slot.

2. The water storage unit as claimed in claim 1, wherein a first sealing unit is located between the first and third plates and connects the first and third plates to seal the inlet of the outer bag.

3. The water storage unit as claimed in claim 1, wherein a second sealing unit is located between the third and fourth plates and connects the third and fourth plates to seal the opening of the inner bag.

4. The water storage unit as claimed in claim 1, wherein an outlet part is connected to a lower end of the outer bag and an outlet tube is connected to the outer part, the outlet tube communicates with an interior of the outer bag and is connected with a hose, said hose has a suction piece connected to a distal end thereof, wherein a cap is removably mounted to the suction piece.

5. The water storage unit as claimed in claim 1, wherein the handle includes a carry hole at a center thereof and two engaging holes are located on two sides of the handle, a plurality of hanging holes are defined through the handle.

6. The water storage unit as claimed in claim 1, wherein a guide tapered end is formed on a second end of the sealing rod and located corresponding to the guide opening in the handle, two protrusions extending from an outside of the close end of the clamp slot and the through hole is located between the two protrusions so as to protect the connection parts of the sealing rod.

* * * * *